US011732998B2

(12) United States Patent
Angers, Jr.

(10) Patent No.: US 11,732,998 B2
(45) Date of Patent: Aug. 22, 2023

(54) ADJUSTABLE, PIVOTING RIFLE STOCK AND METHOD OF USE

(71) Applicant: John W Angers, Jr., Youngsville, LA (US)

(72) Inventor: John W Angers, Jr., Youngsville, LA (US)

( * ) Notice: Subject to any disclaimer, the term of this patent is extended or adjusted under 35 U.S.C. 154(b) by 0 days.

(21) Appl. No.: 17/538,550

(22) Filed: Nov. 30, 2021

(65) Prior Publication Data

US 2023/0168063 A1 Jun. 1, 2023

(51) Int. Cl.

| | |
|---|---|
| ***F41C 23/00*** | (2006.01) |
| ***F41C 23/14*** | (2006.01) |
| ***F41G 1/17*** | (2006.01) |
| ***F41C 23/04*** | (2006.01) |

(52) U.S. Cl.

CPC ..... *F41C 23/14* (2013.01); *F41C 23/04* (2013.01); *F41G 1/17* (2013.01)

(58) Field of Classification Search

CPC ..... F41C 23/04; F41C 23/20; F41C 23/14; F41A 11/04; F41G 1/17

USPC ..... 42/75.03, 73, 71.01, 75.01, 75.1

See application file for complete search history.

(56) References Cited

U.S. PATENT DOCUMENTS

| | | | | |
|---|---|---|---|---|
| 243,553 | A | 6/1881 | Hape et al. | |
| 371,850 | A * | 10/1887 | Maynard | F41A 15/14 42/75.01 |
| 476,246 | A | 6/1892 | Burgess | |
| 843,227 | A | 2/1907 | Munson | |
| 1,295,688 | A | 2/1919 | Butler | |
| 1,468,354 | A | 9/1923 | Caretto | |
| 1,480,350 | A | 1/1924 | Martin et al. | |
| 1,524,973 | A | 2/1925 | Hazelton | |
| 2,436,349 | A | 2/1948 | Adams | |
| 2,453,394 | A | 11/1948 | Wittman | |
| 2,754,608 | A | 7/1956 | Stieffel, Jr. | |
| 4,300,302 | A | 11/1981 | Anschiitz et al. | |
| 4,316,342 | A | 2/1982 | Griggs | |
| 5,194,678 | A | 3/1993 | Kramer | |
| 5,933,997 | A * | 8/1999 | Barrett | F41C 23/14 42/73 |
| 6,698,963 | B1 | 3/2004 | Parker et al. | |
| 6,842,015 | B2 | 1/2005 | Sharp | |

(Continued)

OTHER PUBLICATIONS

Internet Article, Best AR-15 Offset Iron Sights [View-Throughs], Printed Nov. 26, 2021, https://www.pewpewtactical.com/best-offset-irons/.

*Primary Examiner* — Michael D David

(74) *Attorney, Agent, or Firm* — Joseph T Regard, Ltd plc

(57) ABSTRACT

An adjustable shoulder rest for a rear stock for a rifle or shotgun, with slidable adjustment features at the butt plate to customize the shoulder to firearm interface, providing diverse adjustment options pursuant to user preference and/or circumstances of use. The present invention further provides a pivotal, slidably-adjustable shoulder rest to facilitate customized position adjustment to the firearms orientation vis-a-vis the operator, including the option to provide a swivel connection for adjustment of the firearm during operation, even allowing the user to employ various diverse sights mounted to the firearm for user selection via pivoting the firearm, while maintaining undisturbed engagement of the shoulder rest to the shoulder of the user.

15 Claims, 10 Drawing Sheets

(56) References Cited

U.S. PATENT DOCUMENTS

| | | | | |
|---|---|---|---|---|
| 8,215,045 | B2 | 7/2012 | Mitchell | |
| 8,499,483 | B2 | 8/2013 | Quaedpeerds et al. | |
| 9,562,740 | B1 * | 2/2017 | Korliker | F41C 23/14 |
| 10,907,931 | B2 | 2/2021 | Schoenborn et al. | |
| 2007/0253764 | A1 | 11/2007 | Clayton et al. | |
| 2012/0311907 | A1 * | 12/2012 | Cottle | F41C 23/20<br>42/71.01 |
| 2013/0000175 | A1 | 1/2013 | Quaedpeerds et al. | |
| 2016/0187099 | A1 * | 6/2016 | Cottle | F41C 23/14<br>42/73 |

* cited by examiner

FIG 7
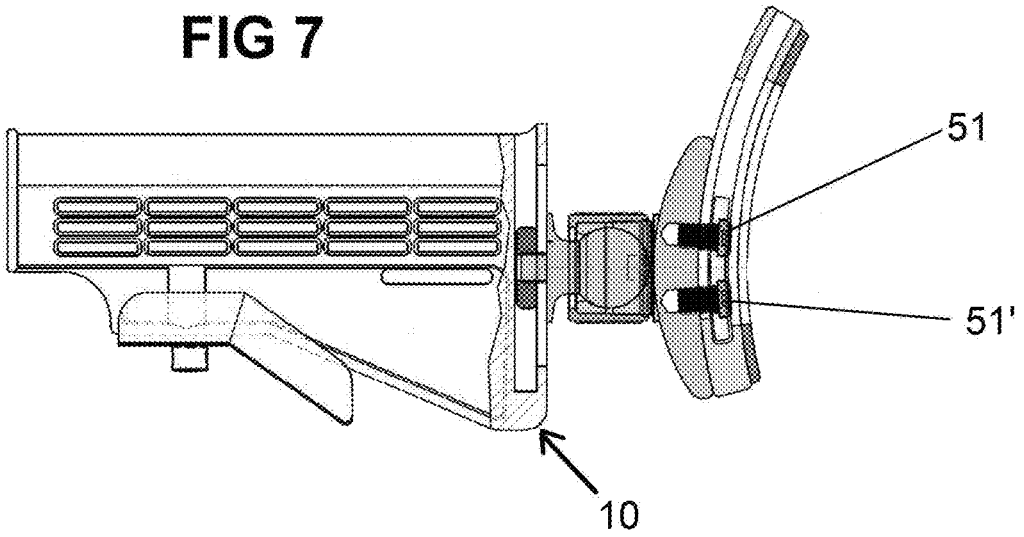
FIG 8
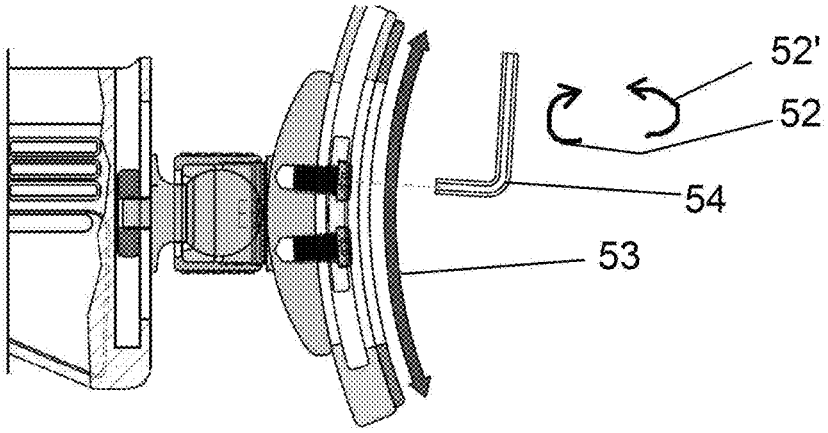
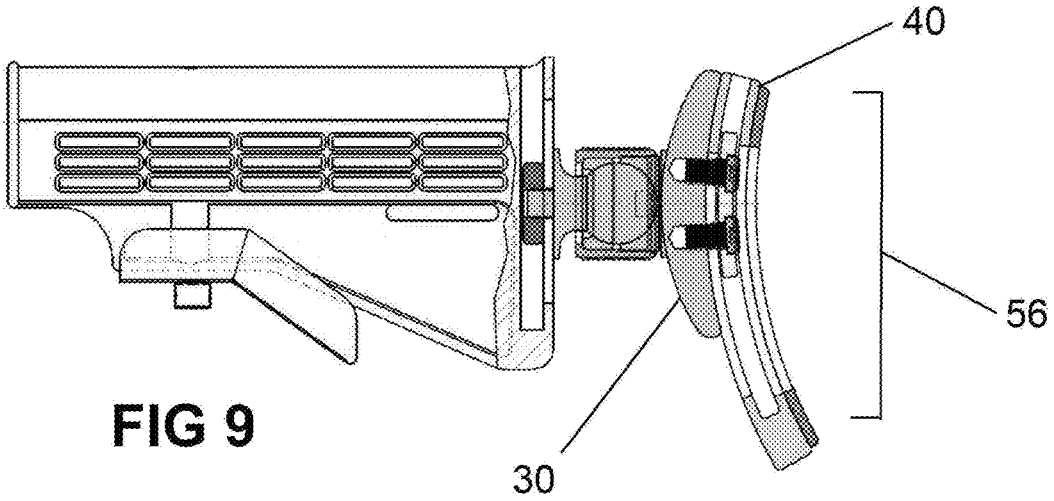
FIG 9

ADJUSTABLE, PIVOTING RIFLE STOCK AND METHOD OF USE

FIELD OF THE INVENTION

The present invention relates to firearms and components therefore, and in particular to an adjustable swivel assembly situated at the butt of a rifle or shotgun to interface with the shoulder of the user, providing customizable orientation of the firearm relative to the shoulder of the user, while being easily and quickly re-adjusted depending on user preference and circumstances of use. The present invention provides a pivotal connection to facilitate supported adjustment of the orientation of the firearm via pivoting or rotation which can be locked to a desired position or provide pivotal support via swivel connection during operation, while maintaining contact with the user.

GENERAL BACKGROUND DISCUSSION OF THE INVENTION

In use, rifles, shotguns and the like generally rest against a shoulder of the user (typically at an area referenced as the pocket of the shoulder) to provide support for the weapon and for providing a line-of-sight anchor point for aiming as well as absorb any recoil during firing. With most fixed stocks, the butt of the stock is placed firmly against the shoulder of the user to provide the anchor point, thus providing a limited swath of movement of the firearm when in use to maintain line of sight, as the user must reposition the shoulder depending on the location (and the required positioning to maintain line of sight) relative to that user.

Repositioning the firearm for line of sight aiming outside of a limited range without repositioning the anchor point (the user's shoulder) may result in only partial engagement of the firearm to the user's shoulder, which can increase the amount of recoil force against a diminished contact area of the user's shoulder, as well as increasing the possibility of injury or discomfort due to insufficient support during, and decreasing the accuracy of any resulting shot.

Recoil pads or the like provided at the butt or distal end of the rear stock can lessen the shock of the recoil, but will not eliminate the problem of having to adjust the shoulder commensurate with the line of sight to maintain anchor point between each shot, decreasing accuracy, as well as slowing response time if one is required to reposition one's shoulder and reacquire the target between shots.

Further, if the butt-plate of the firearm is not fully seated against the shoulder of the user, rapid repeated firings such as via a semi-automatic or automatic weapon can jar any unstable anchor point against the shoulder and possibly force repositioning of the butt-plate vis a vis the shoulder, resulting in reduced accuracy and control.

While various prior patents may contemplate limited aspects related to the present invention, none embody the unique combination wherein the pivotal butt-plate is adjustable to the extent provided, nor the functional configuration of the various components of the present invention to accomplish same.

U.S. Pat. No. 4,316,342 to Griggs issued Feb. 23, 1982 illustrates a device designed to facilitate pivotal repositioning of the rear stock of the firearm relative to the user for recoil dampening/absorption. See also Wittman U.S. Pat. No. 2,543,394 issued Nov. 9, 1948.

Patent 843227 to Munson issued Feb. 5, 1907 and 243553 to Hape et al issued Jun. 28, 1881 illustrate pivoting rear stocks are adjustable to optimize the configuration for the user and circumstances of use.

Patent Application Publication US2013/0000175A1 to Quaedpeerds et al published Jan. 3, 2013 provides a rear stock having an end with recoil pad engaged thereto via ball joint which can be adjustably positioned, so as to facilitate adjustment pad to best engage the shooter in use.

U.S. Pat. No. 8,215,045 teaches a ball and socket assembly used to pivotally mount and secure, via straps or the like, the buttstock of an assault rifle to the shoulder of a user, to stabilize same and maintain position during operation.

SUMMARY DISCUSSION OF THE INVENTION

The present invention provides a uniquely adjustable, pivotable butt-plate adjustably emanating from the rear stock of a rifle or shotgun, which is configured to facilitate optimal engagement to the shoulder of the user, while providing diverse and various adjustment features to fully customize the shoulder to firearm interface, as well as providing the capability for ready re-configuration to accommodate user preference and circumstances of use.

The present invention is particularly suited for competitive shooting, providing a stable, non-moving anchor point for rifles or the like to keep line of sight anchor point consistent through the motions associated with aiming the firearm while maintaining a firm anchor point for line of sight.

A ball joint built associated with the butt end of the gun stock provides an enhanced anchor point of the rifle to provide an expanded target acquisition area for line-of-sight aiming while maintaining a stable anchor point at the user's shoulder, and allowing for pivotal readjustment at the anchor point via pivotal, ball and socket connection. While this is particularly useful in competitive shooting, law enforcement as well as military use, and other situations, also will find this a significant performance enhancement over prior systems.

The preferred embodiment of the present invention utilizes a first slot formed along the butt of the rear stock and having an opening formed along the rear edge of the stock. A second slot emanating from the butt end of the rear stock engages the first slot. The first slot is formed to slidingly receive a ball joint retainer, which has a threaded passage formed therethrough to engage a pivot ball having a base via a threaded portion emanating from said base and passing through a second slot at the end of the stock to engage pivot ball retainer (in the second slot) via its threaded passage, so that the base of the pivot ball rests against the butt end of the rear stock. An enveloping nut with friction washer and adjustable buttstock connector combination engage the pivot ball to provide a ball and socket-type swivel connection, while allowing the ball to be adjustably situated along the butt end of the buttstock, via the slotted connection.

The cylindrical nut has first and second ends, each forming an opening, and is provided to slide over and partially envelope the ball portion of the pivot ball, as well as receive the friction washer about the neck of the pivot ball to retain same in place. The adjustable buttstock connector has a threaded connector member emanating therefrom formed to engage the inner wall of the nut partially enveloping the pivot ball, providing pivotal engagement while engaging the buttstock connector to the ball portion of the pivot ball.

In use, the present invention allows multiple adjustments as to the position/orientation of the buttstock/butt plate to the shoulder of the user. Further, the pivot ball can be adjusted as to line of sight orientation of the firearm relative to the anchor point at the shoulder of the user, and either be fixed in a particular predetermined orientation (via tightening the friction washer via the threaded connection of the adjustable buttstock connector with the nut), or provide an active pivotal feature to allow the user to pivot the firearm relative to the user in real time (by loosening the nut pressure against friction washer at the pivot ball), while maintaining the buttstock securely against the shoulder of the user to maintain a firm anchor point for line-of-sight orientation.

The present thereby provides an easily implemented, reliable, cost effective, unique and innovative system to customize how the rear stock engages the shoulder of the user during use, while quickly and easily allowing re-adjustment to accommodate changes in operating requirements of a firearm and circumstances of use, etc.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 7 is a side, partial, partially cutaway of the invention of FIGS. 1-6, illustrating the adjustable buttstock shoulder rest engaging the adjustable buttstock connector via first and second fasteners and position lock plate situated at the second end of an adjustment slot formed along the length of said buttstock shoulder rest.

FIG. 8 is a side, partial, partially cutaway of the invention of FIG. 7, illustrating the adjustable buttstock shoulder rest engaging the adjustable buttstock connector via loosened first and second fasteners, and position lock plate situated about medially in said adjustment slot formed along the length of said buttstock shoulder rest.

FIG. 9 is a side, partial, partially cutaway of the invention of FIG. 8, illustrating the adjustable buttstock shoulder rest engaging the adjustable buttstock connector via first and second fasteners, and position lock plate repositioned so as to be situated towards the first end of said adjustment slot formed along the length of said buttstock shoulder rest.

DETAILED DISCUSSION OF THE INVENTION

Figure 1:
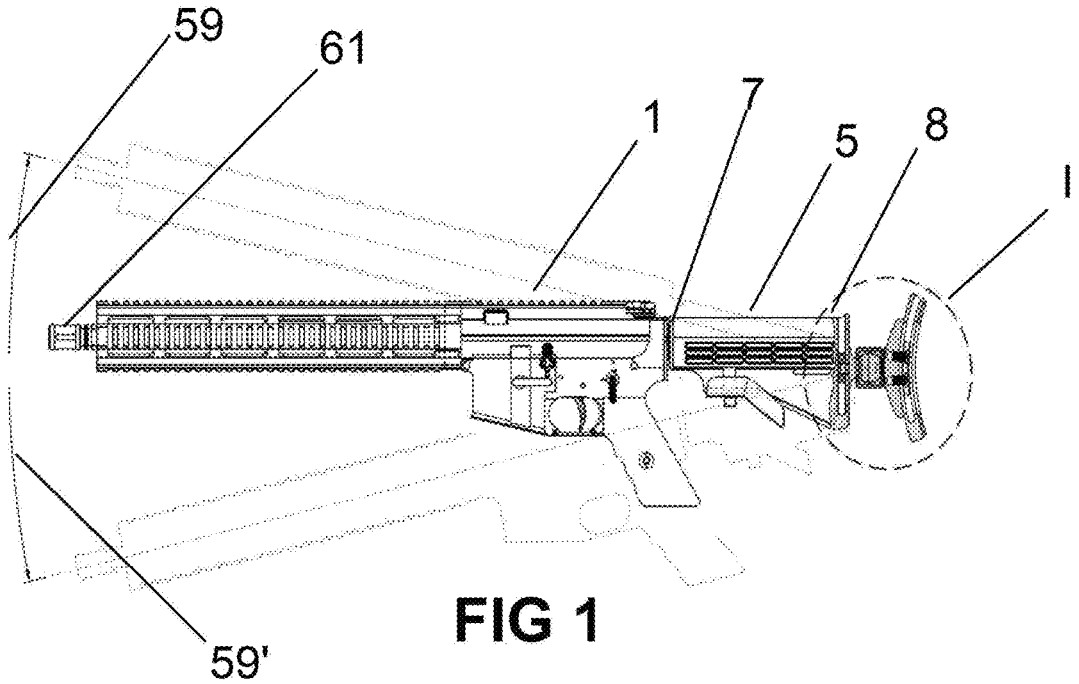
FIG. 1 is a side, partially cutaway view of an exemplary firearm having the apparatus of the present invention mounted to the butt-end of the rear stock, showing the vertical range of motion afforded by the ball and socket swivel connection, in phantom.
Figure 2:
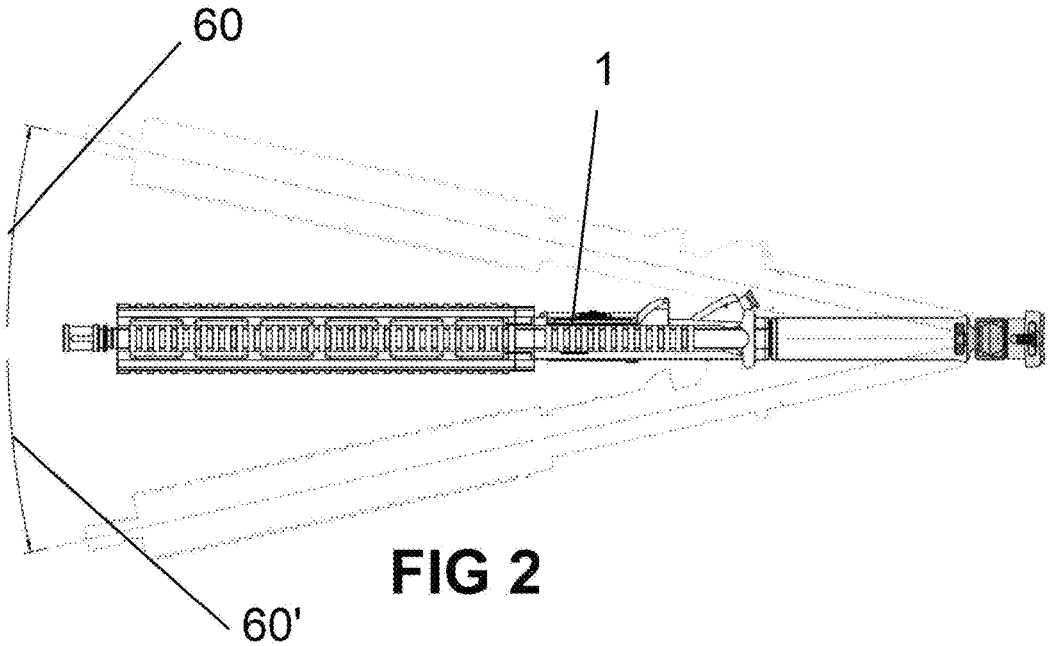
FIG. 2 is a top, partially cutaway view of the invention of FIG. 1, showing the horizontal range of motion afforded by the pivot ball retainer and slot connection forming the ball and socket swivel connection, in phantom.

Referring to FIGS. 1-9, 11-14, and 15, the preferred embodiment I of the present invention emanates from or is mounted to a stock 5 for a firearm 1 having first 6 and second 6' ends, which correspond to the butt 8 and tang 7 of the stock 5, respectively. The butt 8 of the stock 5 further has a first 5' (upper) and second 5" (lower) end corresponding to the heel 9 and toe 9' of the stock, respectively, the tang 7 engaging the receiver 2 of the firearm 1.

Continuing with Figures, situated at the butt 8 end of the stock, either integrally or as an add-on, is a ball-joint carrier 10 assembly comprising a butt plate 10' at its end, the butt plate 10' situated over the length of a first slot 11, which slot is formed in the stock (or add-on applied thereto). The slot 11 is formed to provide an outer access opening 11' near the heel 9 of the butt 8, providing a passage from the first 5' end extending therethrough to about the second 5" end of the butt 8, situated in alignment behind the butt plate 10'. An access opening could also be provided in addition to or alternatively near the toe 9' of the butt 8 of stock 5.

The butt plate 10' at the end of the stock has a formed laterally therethrough a second slot 12 medially 12' situated along its length, and has a length 13 and width 13' dimensioned to allow a threaded shaft to adjustably pass therethrough to access the first slot and slidably adjusted along its length, as will be further discussed herein.

The first slot 11 is formed to slidingly receive a ball joint retainer 14, which has a threaded passage 15 formed therethrough. A pivot ball joint 16 having base 19 with a ball 17 having a top 17" on one end, a neck 18 between the ball 17 portion and the base 19, and a threaded shaft 20 emanating from the base on the other end is provided with the threaded shaft 20 formed to pass through the second slot 12 and engage the pivot ball retainer 14 slidably situated therein via its threaded passage 15, so that the base 19 of the pivot ball joint 16 is slidably adjustable 38 along the length of the butt 8 of the stock or ball joint carrier 10 mounted thereto, depending on whether it (the ball joint carrier) is an add-on, or formed in the stock itself. After adjusted to the desired position, the ball joint 16 can rotated so as to threadingly engage the threaded passage 15 of ball retainer 14 via hex socket 17' on the top 17" of ball 17 to tighten 39 and retain the ball joint 15 against butt plate 10' to the in the desired position along slot 12.

The ball 17 has an OD 20' formed to receive thereabout a nut 21 having an ID 22 and a length having first 23 and second 23' ends, each end forming an opening, the first end 23 of nut 21 having an inwardly projecting lip 24 around its inner circumference, the second end 23' having taper 25' in the wall thickness narrowing toward said second end 23', the nut formed to slidingly, partially envelope 24' ball 17. Further provided is a threaded area 25 along the ID 22 of the nut 21 at its second end 23'.

A friction washer F is shown comprising two components 26, 26', the washer when assembled having an outer 26" diameter, an inner 27 diameter and first 27' and second 27" open ends, an edge 28 at the first 27' end and an outwardly facing radial taper 28' formed to engage the outer surface of ball 17 at the second 27" end, the friction washer situated about the neck 18 of the ball joint 16 to retain same in place (FIG. 14), with the nut 21 enveloping both the OD 26" of friction washer F, and ball 17 of ball joint 16, with the edge 28 of friction washer which is split, comprising two components for separation during installation 26, 26' about the neck 16 of ball joint 16, then enveloped and contained by the nut which is slipped over, engaging the lip 24 of nut 21.

Figure 3:
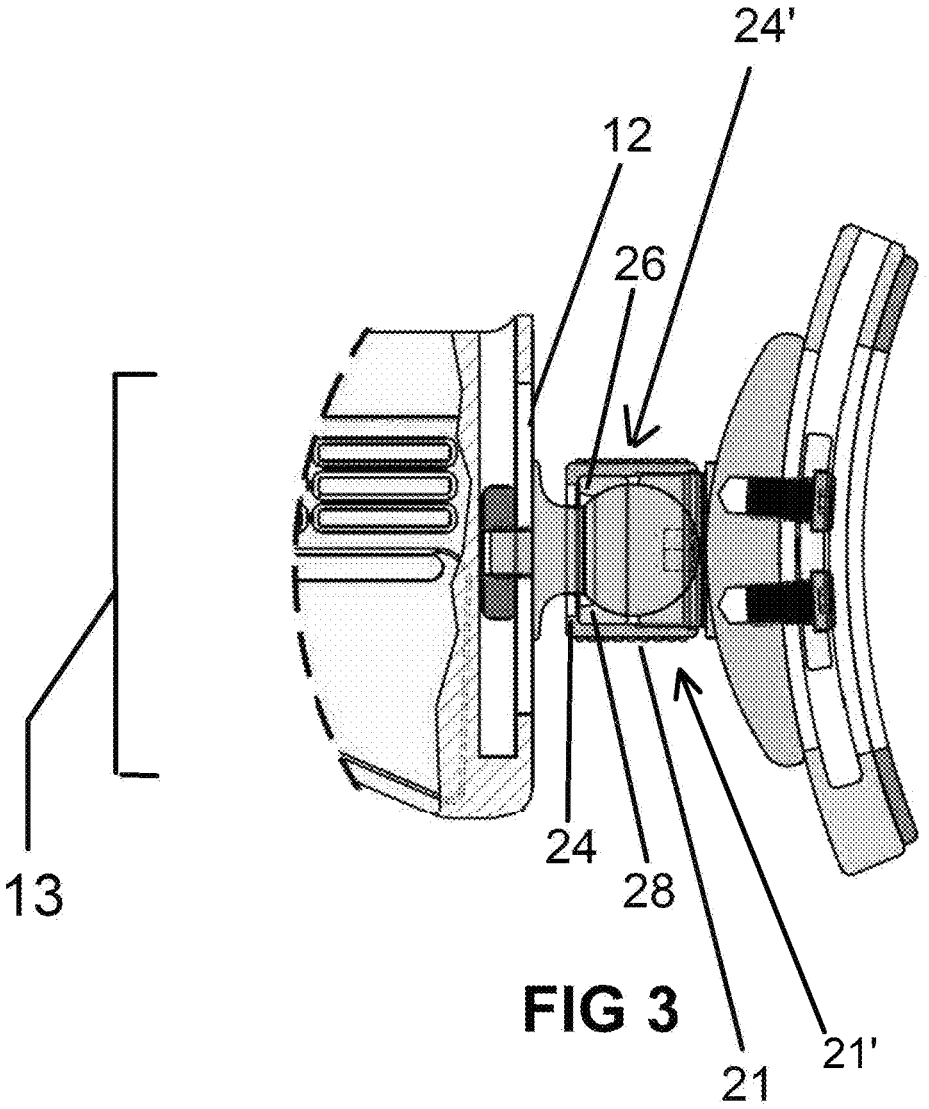
FIG. 3 is an enlarged, partial, cutaway, side view of the preferred embodiment of the apparatus of the present invention.
Figure 4:
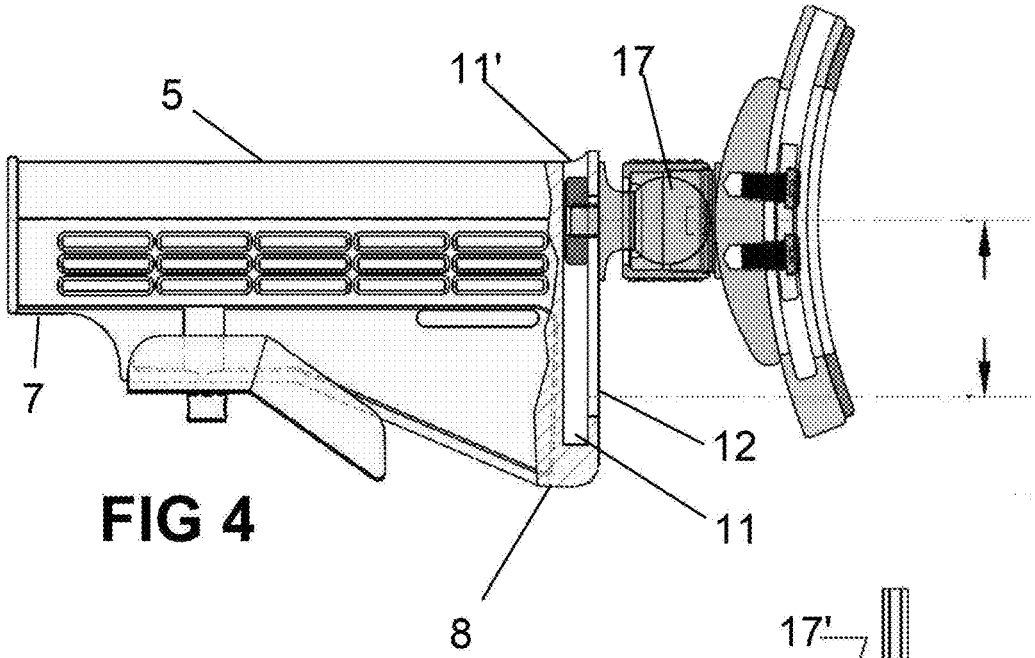
FIG. 4 is a side, partial, partially cutaway view of the invention of FIGS. 1-3, illustrating the device of the present invention mounted to an exemplary rear stock of a firearm, and illustrating the range of adjustment provided by the pivot ball retainer along a slot formed along the ball joint carrier at the butt-end of the rear-stock.
Figure 5:
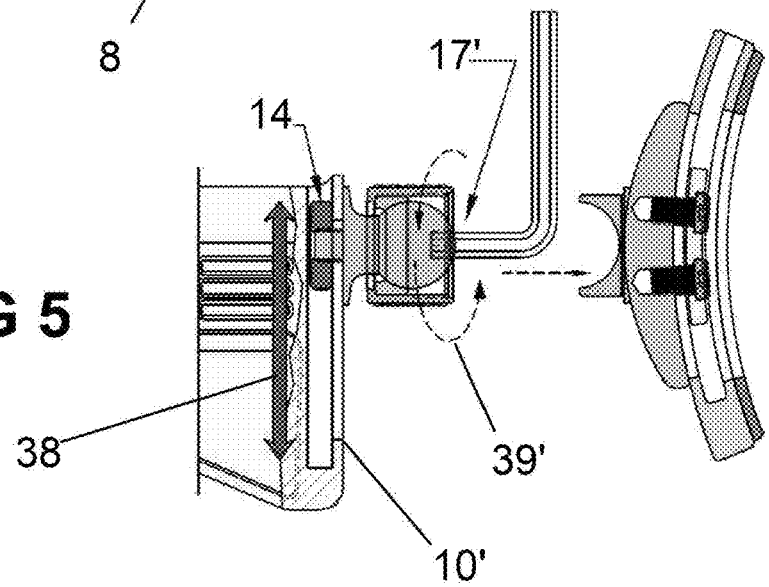
FIG. 5 is a side, partial, partially side cutaway view of the invention of FIG. 4, illustrating the loosening of the pivot ball of said slot to facilitate repositioning of the pivot ball joint retainer from a first end to a second end of said slot.
Figure 6:
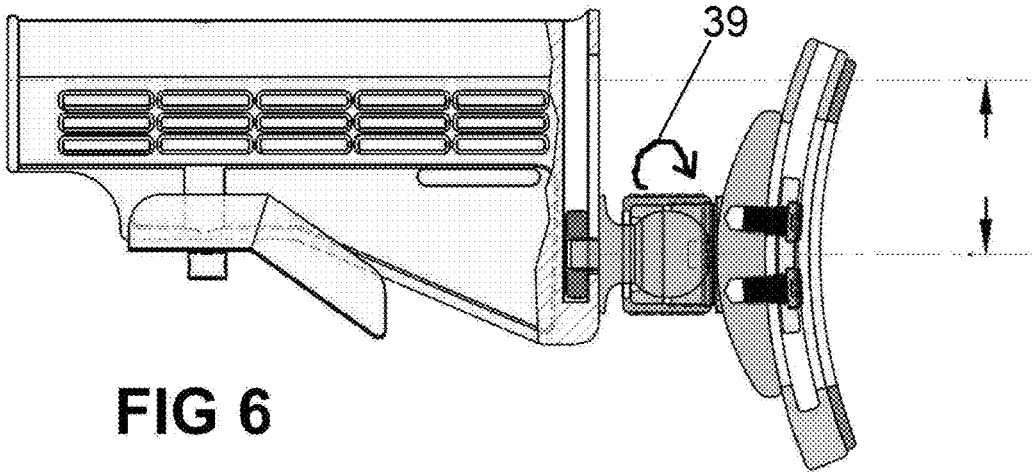
FIG. 6 is a side, partial, partially side cutaway of the invention of FIG. 5, showing the repositioned pivot ball joint retainer at said second end of said slot.
Figure 10:
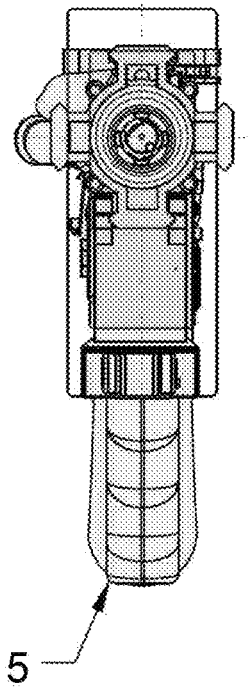
FIG. 10 is a frontal view of the barrel end of the firearm of FIG. 1 as conventionally utilized in the horizontal orientation.
Figure 11:
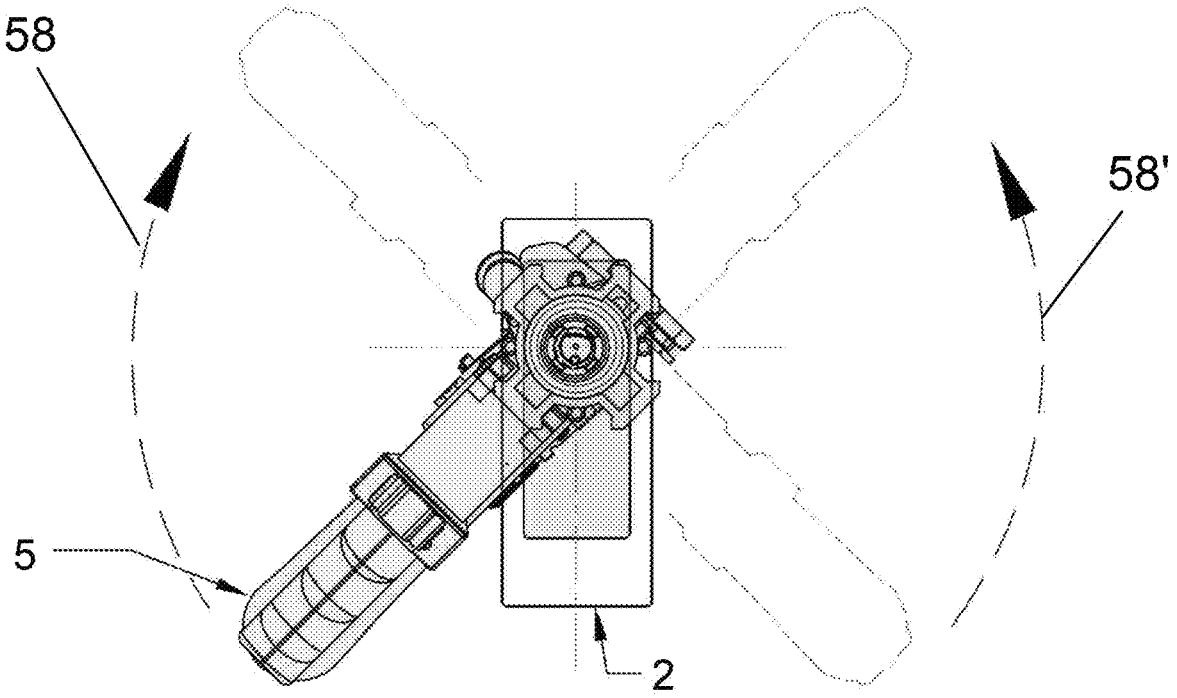
FIG. 11 is a frontal view of the invention of FIG. 1 illustrating an exemplary range of pivot provided by the ball retainer and slot connection forming the ball and socket swivel connection at the rear stock, as shown in FIGS. 1-9.
Figure 12:
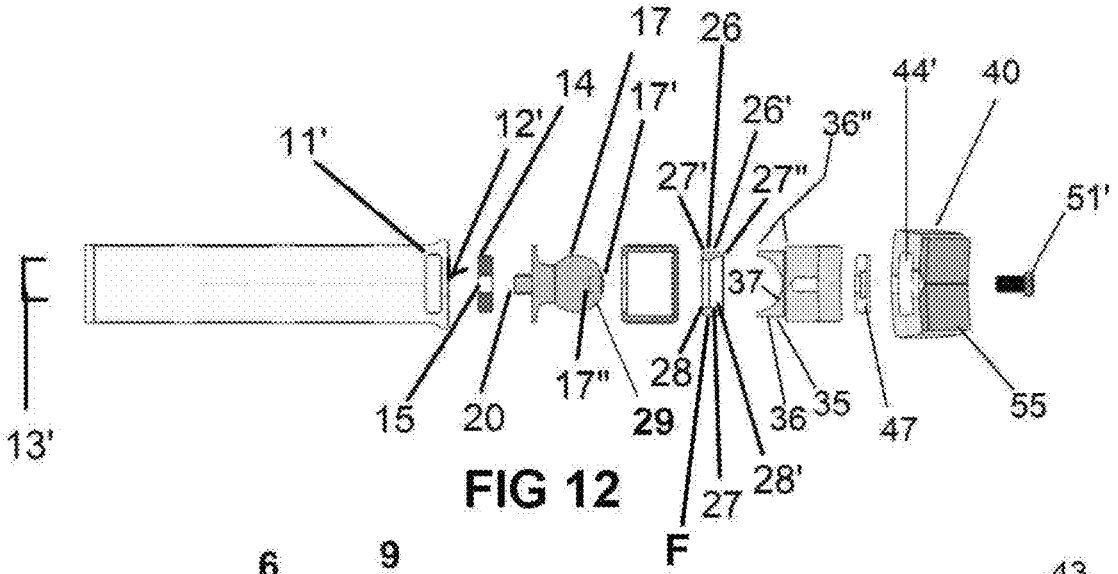
FIG. 12 is a top, exploded view of the invention of FIGS. 3-9.
Figure 13:
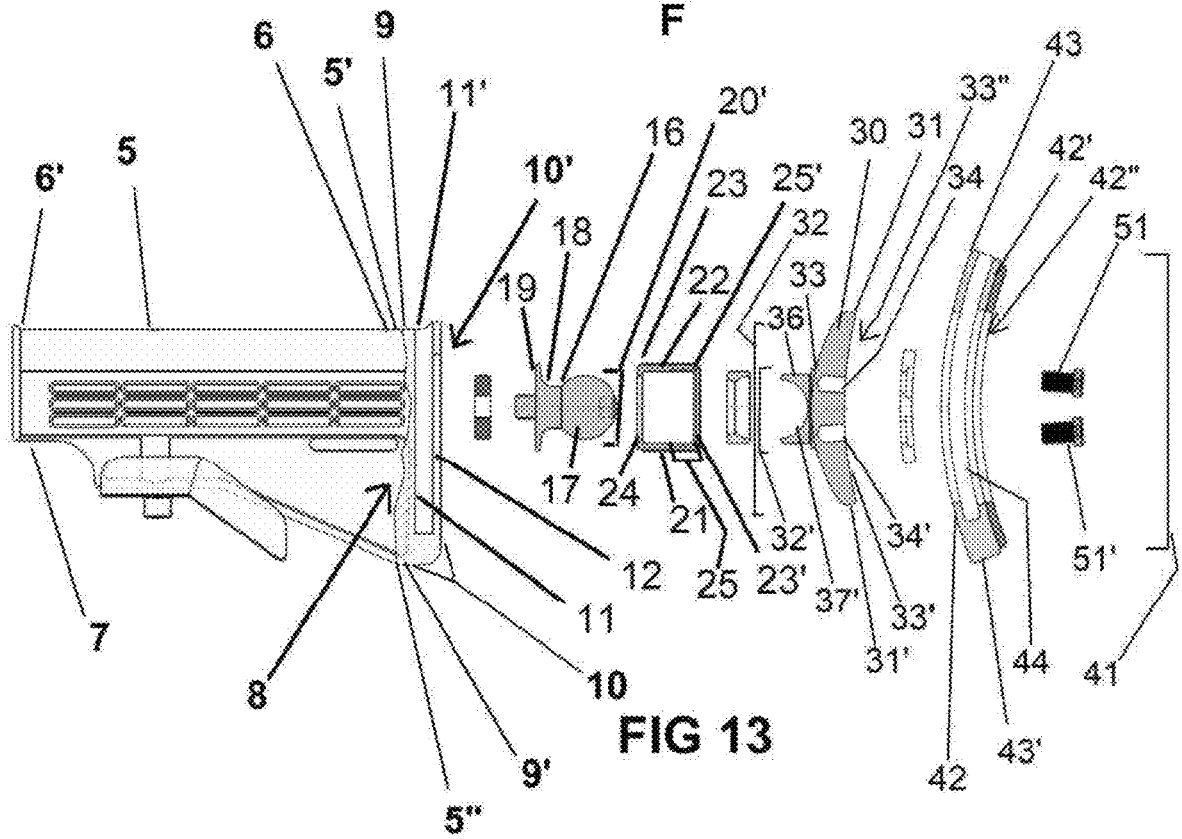
FIG. 13 is a side, exploded view of the invention of FIG. 12.
Figure 14:
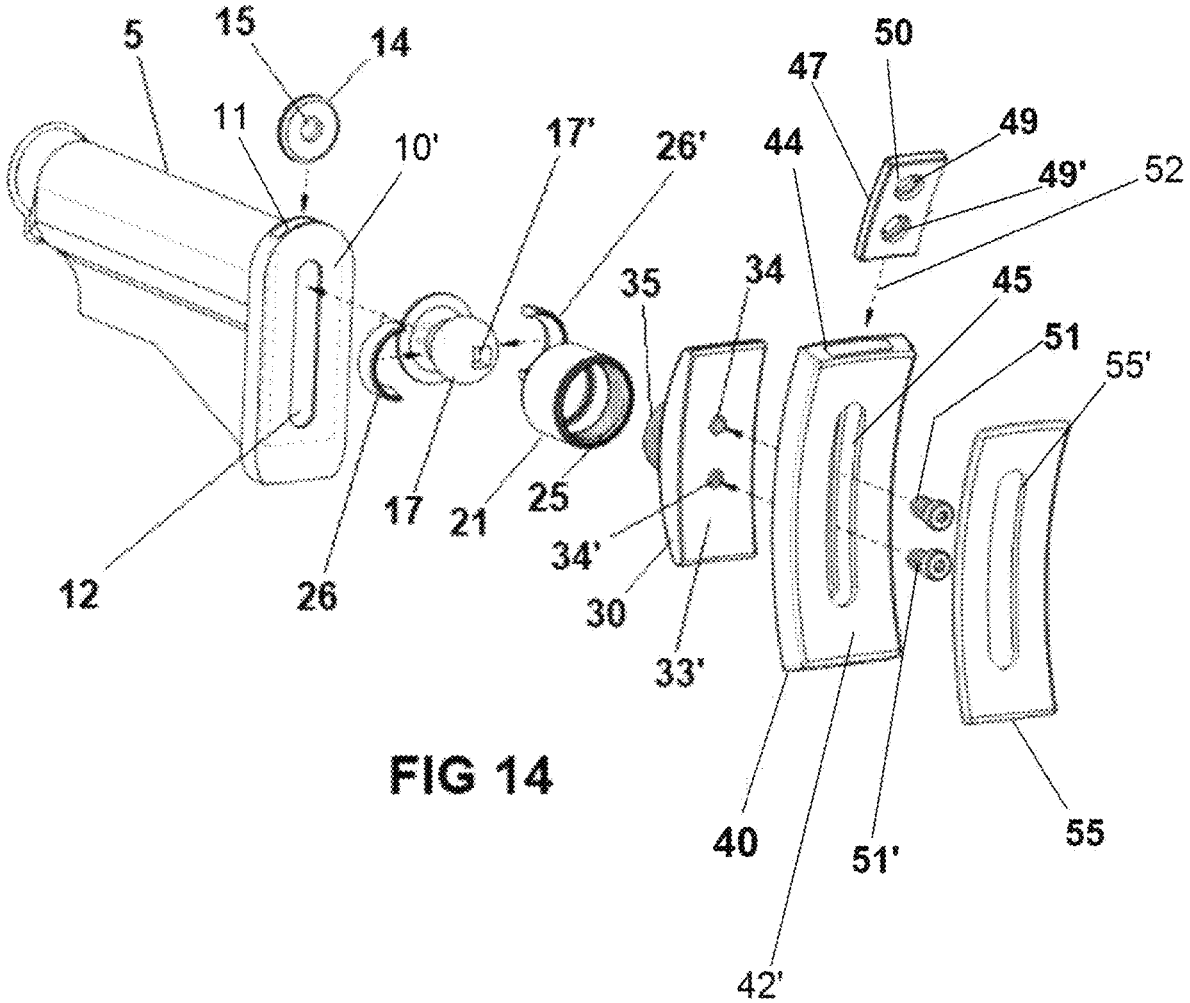
FIG. 14 is a perspective, exploded view of the invention of FIG. 12.

An adjustable buttstock connector 30 is provided having first 31 and second 31' ends and a medial area 32' therebetween, and a length 32 being radially curved 33" away from the stock 5, with a front 33 and rear 33' side. Emanating from the front 33, medial 32' area is a swivel extension 35 having a length 36" having an outer diameter (OD) 36 which is threaded 36', and a hemispherical cavity 37 formed therein having an inner wall 37' provided to engage the outer surface 29 of the top 17' of the ball 17, with the OD 36 formed to engage the threaded 25 inner diameter 25 of the nut 21 when enveloping/engaging the pivot ball (as shown in FIG. 3), providing pivotal engagement 21' (FIG. 3) which can be adjusted to a desired position (or providing a swivel connection) via loosening or tightening the threaded connection between nut 21 and swivel extension 35, the greater tightening the greater resistance to movement. Situated in the medial 32' rear 33' portion of the buttstock connector 30 are two spaced threaded passages 34, 34' for receiving threaded connectors 51, 51', as will be further discussed infra.

The final component in the preferred embodiment of the invention comprises a shoulder rest 40 having a length 41 and opposing first 42 and second 42' sides and first 43 and second 43' ends, the second side 42' formed to receive a relief pad 55 mounted thereto for contacting the shoulder of the user, the shoulder rest further comprising a first slot 44 formed along its length 41 to slidingly 53 receive a position lock plate 47 therein for adjustably mounting the shoulder rest to the buttstock connector 30, the position lock plate 47 formed to receive two fasteners 51, 51' which lengths pass through a second slot 45 formed through the first and second sides of the shoulder rest 40. First and second fasteners 51, 51' engage first 49 and second 49' countersunk 50 passages in the lock plate 47 which is shown slidably positioned in the first slot 44, respectively engaging first 34 and second 34' threaded passages in adjustable buttstock connector, respectively, so that the shoulder rest 40 is positionable (see FIGS. 7-9) vs the buttstock connector 30 via loosening 52 (such as via wrench 54) fasteners 51, 51', and sliding 53 the shoulder rest 40 along its length via the slotted connection with lock plate 47, then tightening 52' fasteners 51, 51' at the desired position 56, such as where the firearm sights are aligned with the user's line of sight to the target.

In use, continuing with FIGS. 1-15, as previously discussed, the present invention 1 allows multiple adjustments as to the position/orientation of the buttstock/butt plate to the shoulder of the user. The pivot ball can be adjusted so as to facilitate axial orientation 58, 58' of the firearm along its longitudinal axis relative to the user as either fixed in a particular, preferred orientation (via tightening the friction washer via the threaded connection of the adjustable buttstock connector with the nut), as well as providing an active swivel feature to allow the user to pivot the tip 61 of the firearm 1 up 59 or down 59', side 60 to side 60', or axially 58, 58' along its length, or any combination thereof, relative to the user U in real time (by loosening the friction washer at the pivot ball), while maintaining the buttstock securely against the pocket of the shoulder of the user.

The present invention is particularly suited to aid in the competition shooting, hunting, or military use of firearms, providing a stable, non-moving anchor point for the rifle (via shoulder rest 42 engaging the pocket of the shoulder S of the user U to keep line of sight 57 anchor point consistent through motion shooting and twisting of the gun in use in a variety of applications, including but not limited to improving line-of-sight aiming and target acquisition for a fixed stationary as well as moving target, or providing rapid sequential targeting in the case of multiple targets.

The use of one or more rail mounts for firearms for mounting accessories is well known, and can include such diverse configurations as the Picatinny/NATO rail (shown in FIGS. 15-17), or other mounting options such as provided by the Weaver rail, as well as, for example, ARCA, M-LOK/MOE, KEYMOD, dovetail, and other rail configurations. One or more rails can be mounted along the length of the firearm for mounting various accessories such as lasers, flashlights, supports such as bipods or monopods, carrying handles, sling mounts, various sighting options, etc. More than one rail can be mounted at, for example, 90 degrees relative to one another (as shown in the figures) on the firearm as well as other orientations including 45 degrees, for example.

Figure 15:
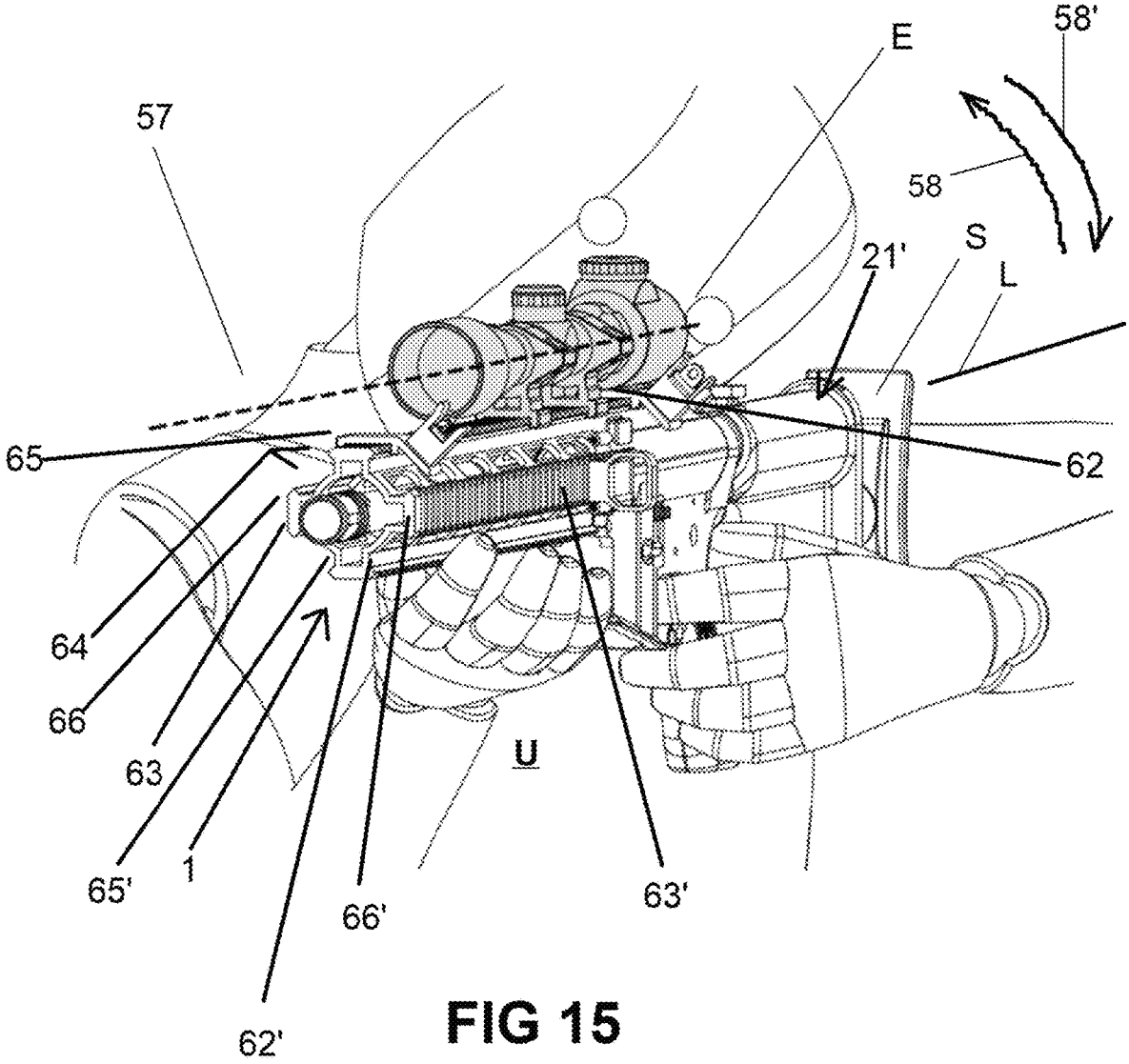
FIG. 15 is a perspective view of a user utilizing the invention of the present invention by pivotally adjusting the firearm via the ball and socket swivel at the rear stock to facilitate line of sight aiming through a scope, or telescopic sight.
Figure 16:
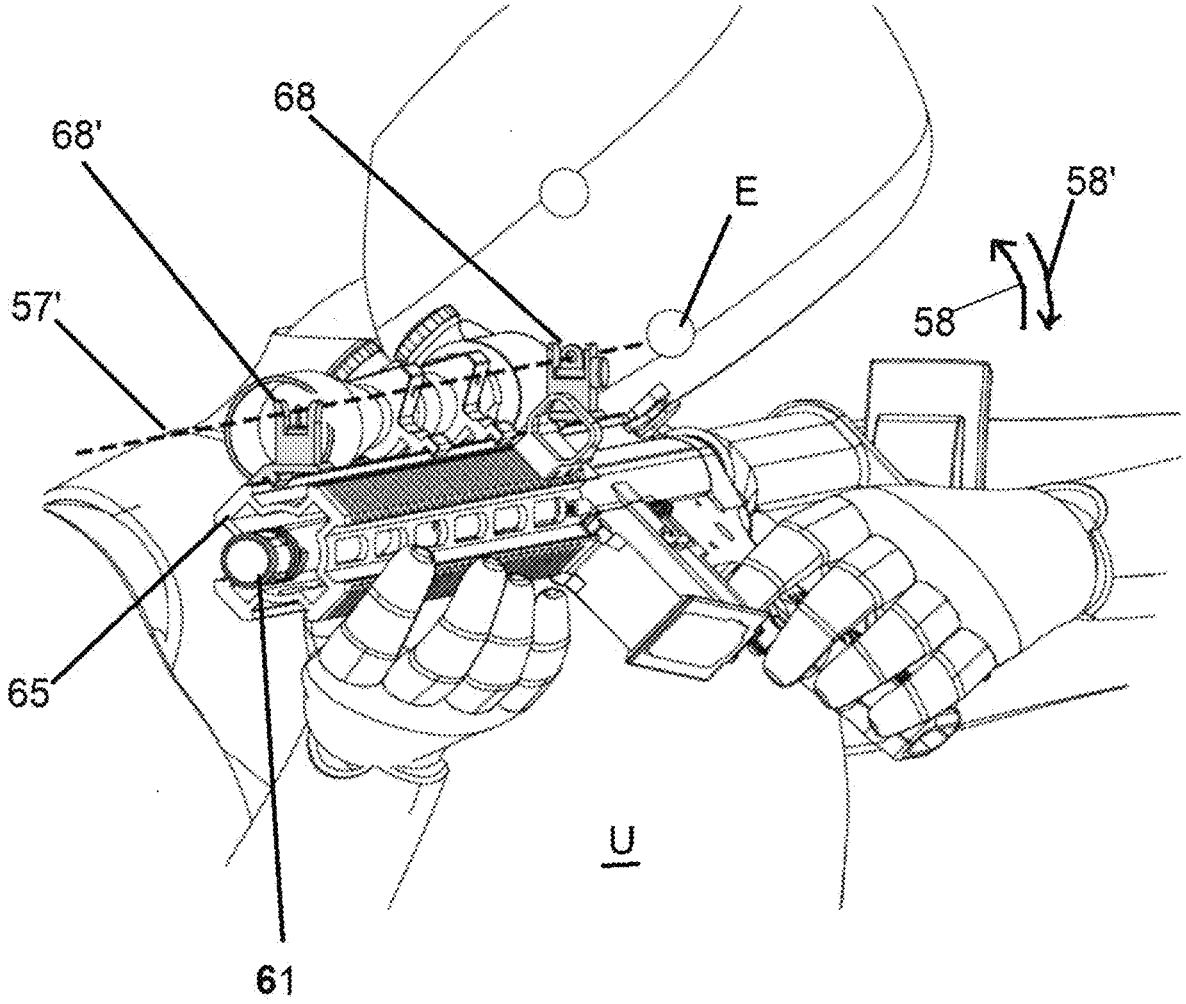
FIG. 16 is a perspective view the invention of FIG. 15, illustrating a user utilizing the invention of the present invention by pivotally adjusting the firearm to facilitate line of sight aiming via an iron sight, also known as an open sight.
Figure 17:
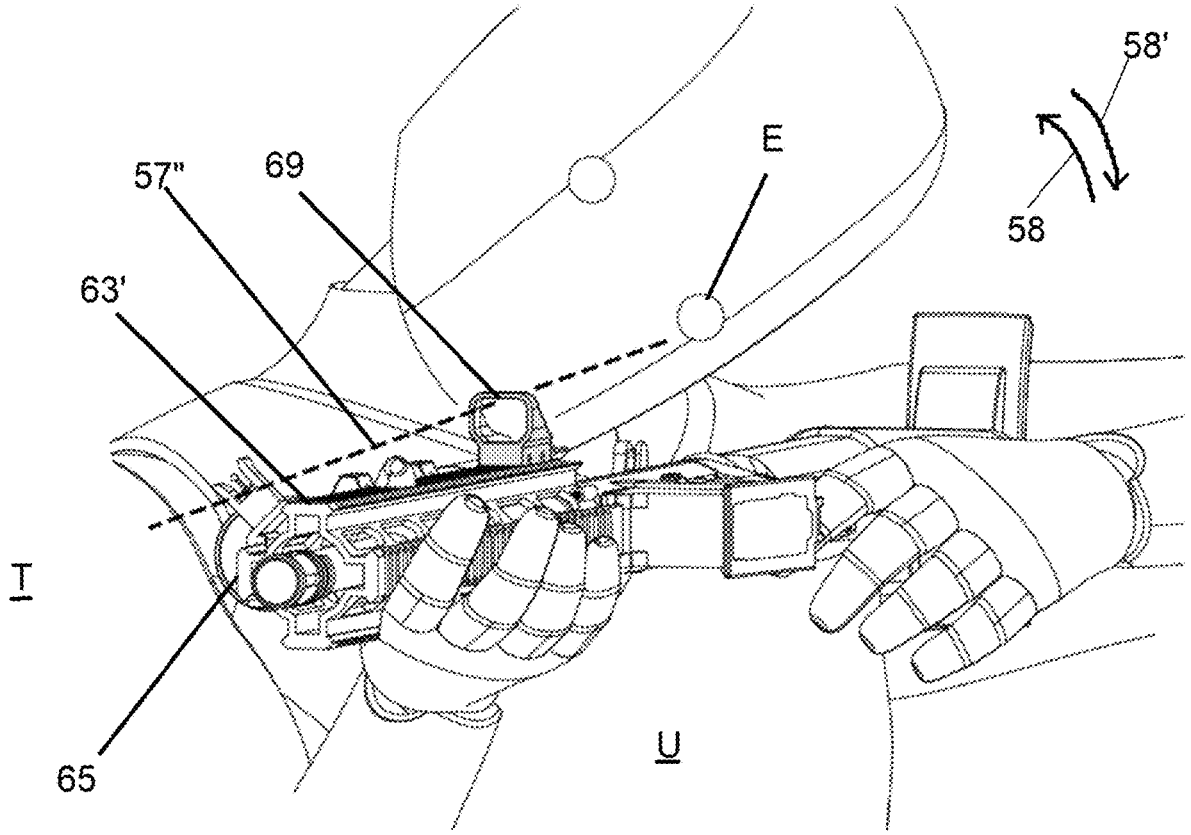
FIG. 17 is a perspective view the invention of FIG. 15, illustrating a user utilizing the invention of the present invention by pivotally adjusting the firearm to facilitate line of sight aiming via a reflex sight.

Continuing with FIGS. 15-17, the present invention provides an innovative means of accessing on demand a variety of sight options provided on the firearm via the swivel action of the present invention as needed in real time, allowing the user to select and utilize best aiming device taking into account the particular circumstances of use, target being acquired, distance, light conditions, etc.

FIGS. 15-17 illustrate a firearm 1 having top 62, bottom 62', as well as inner 63 and outer 63' side mounting rails situated at 90-degree intervals 64 along the top or upper 65, bottom or lower 65', inner 66, and outer 66' sides of the firearm 1, respectively.

FIG. 15 shows the firearm 1 situated in a horizontal shooting position with the scope situated along the upper 65 rail 62 mounted to the firearm 1. The user U positions the shoulder rest 42 in the pocket of the shoulder, and (via swivel or pivotal connection 21'), pivots or axially orients 58, 58' the firearm along its longitudinal axis L, while positioning the eye E of the user to align with the scope to provide a line of sight 57 to the target via the scope 62, and aim the firearm accordingly.

FIG. 16 illustrates the option of an iron or open sight comprising rear 68 and front 68' sights, respectively, which are mounted to the top rail 62 of the firearm and positioned to lie at a forty-five-degree angle therefrom on the outer side of the firearm 1. Alternatively, the sight could be mounted directly to the firearm at the forty-five-degree angle via a mount, rail or the like.

In such a configuration, if the user U decides to utilize the iron or open site option, with the shoulder rest 42 in place, the firearm is pivoted to axially orient 58, 58' the firearm to position the eye E of the user in alignment with the rear 68 and front 68 iron or open sights along the line of sight 57' aligned with the target.

FIG. 17 illustrates still another example or use, where the option of a reflex sight 69 is provided which is shown mounted to the outer side rail 63' of the firearm and as such is positioned to be situated along at a ninety-degree angle from on the top 65 of the firearm 1.

In such a configuration, if the user U decides to utilize the reflex site in use, with the shoulder rest 42 in place against the shoulder of the user, the firearm is pivoted to axially orient 58, 58' the firearm to position the eye E of the user in alignment with the reflex site 68 along the line of sight 57", in alignment with the target T.

Accordingly, the present invention allows a user the option of choosing from a variety of aiming options in real time by mounting an aiming option about the firearm as disclosed above, then utilizing the previously disclosed pivotal connection (21' in FIG. 3) to pivot and axially orient the firearm along its longitudinal axis to reposition the firearm to provide line-of-sight access to the desired aiming option by the user while in use.

ELEMENTS OF THE INVENTION

I Invention
S pocket of shoulder
U User
E Eye
L Longitudinal axis of firearm
1 firearm
2 receiver
3,' first, second ends
4 barrel
5 stock
6,' first, second ends
7 tang
8 butt
9,' heel, toe
10,', ball-joint carrier, butt plate
11,'," first slot, length, opening
12,' second slot medially situated
13,' length, width
14 pivot ball retainer
15 threaded passage
16 ball joint
17,'," ball, nut/socket, top
18 neck
19 base
20,' threaded shaft, ball OD
21 nut
22 ID
23,' first, second open ends
24,' lip, slidingly envelope
25,' threaded area, taper
26,'," friction washer. OD
27,'," ID, first, second opposing open ends
28,', edge, taper
29 ball outer surface
30 adjustable buttstock connector
31,' first, second ends
32,' length, medial area
33,'," front, rear, radius
34,' first, second threaded passages
35 swivel extension
36,'," OD, threaded portion, length
37,' hemispherical cavity, inner wall formed to engage outer surface of top of ball
38 slidably adjustable
39,' tightened, loosened
40 shoulder rest
41 length
42,'," first side, second side, radius
43,' first, second ends
44,' first slot, opening
45 second slot aligned w/first
46 width
47 position lock plate
48,' width, length
49,' first, second passages
50 countersunk
51,' threaded fasteners
52,' loosening, tightening
53 sliding
54 wrench
55, ' relief pad, slot
56 desired position
57 line of sight
58,' axial rotation
59,' pivot vertical
60,' pivot horizontal
61 tip
62, 62' upper/top lower bottom rails
63, 63' inner, outer side rails
64 ninety-degree position
65,' top, bottom of firearm
66,' inner, outer side of firearm
67 telescopic sight or scope
68,' iron or open site
69 reflex sight The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. An adjustable shoulder rest for a firearm, comprising:
a rear stock having first and second ends, said first end having associated therewith a butt plate having a length and a side;
a first slot formed through said butt plate along said length of said butt plate;
a second slot formed medially along said side of said butt plate so as to provide passage through said butt plate to said second slot;
a retainer slidingly situated in said first slot;
a pivot ball having an outer diameter, said pivot ball further having a base formed to engage said retainer situated in said first slot of said butt plate, via connection passing through said second slot of said butt plate, so as to be selectively positionable along the length of said butt plate;
a shoulder rest formed to engage said rear stock via a pivot ball joint comprising said pivot ball.

2. The apparatus of claim 1, wherein said pivot ball joint further comprises a nut having first and second ends, and an inner diameter formed therethrough to engage said outer diameter of said pivot ball, said nut further containing a friction washer situated within the inner diameter of said nut, said first end of said nut formed to engage said outer diameter of said pivot ball at one end of said nut, and a butt stock connector formed to engage said pivot ball at the other end of said nut.

3. The apparatus of claim 2, wherein said friction washer is split.

4. The apparatus of claim 3, wherein said butt stock connector engages said nut via a threaded connection, such that tightening said threaded connection reduces swivel action in said pivot ball connection with said butt stock connector, and loosening said threaded connection increases swivel action in said pivot ball connection with said butt stock connector.

5. The apparatus of claim 4, wherein there is further provided a shoulder rest having a length formed to engage said buttstock connector.

6. The apparatus of claim 5, wherein said shoulder rest has a slot formed along its length, said shoulder rest further comprising:

a position lock plate formed to be positioned into said slot of said shoulder rest, said position lock plate engaged to said buttstock connector via at least one fastener such that tightening said fastener allows said position lock plate to be positioned along said slot of said shoulder rest, and tightening of said fastener facilitates said position lock plate to be locked in position along said slot.

7. The apparatus of claim 6, wherein said shoulder rest is curved and has first and second sides, said first side engaging said adjustable buttstock connector, said second side formed to engage a shoulder of a user.

8. The apparatus of claim 7, wherein said second side of said shoulder rest has mounted thereto a relief pad.

9. The apparatus of claim 8, wherein said relief pad has a length, with a slot formed medially along said length, said slot of said relief pad in alignment with said slot of said shoulder rest.

10. A method of utilizing a firearm having a longitudinal axis, comprising the steps of:

a. providing a rear stock having first and second ends, said first end having associated therewith a butt plate having a length and a side;

a first slot formed through said butt plate along said length of said butt plate;

a second slot formed medially along said side of said butt plate so as to provide passage through said butt plate to said second slot;

a retainer slidingly situated in said first slot;

a pivot ball having an outer diameter, said pivot ball further having a base formed to engage said retainer situated in said first slot of said butt plate, via connection passing through said second slot of said butt plate, so as to be selectively positionable along the length of said butt plate;

a shoulder rest formed to engage said rear stock via a pivot ball joint comprising said pivot ball;

b. adjusting the position of said pivot ball along said length of said butt plate via said second slot of said butt plate;

c. positioning said shoulder rest at the shoulder of a user;

d. pivoting said firearm via said pivot ball joint to allow said user to facilitate line of sight aiming of said firearm at a first target.

11. The method of claim 10, wherein there is further provided after step "a", the added steps of:

ai. mounting a first sight to said Firearm along said longitudinal axis of said firearm;

aii. mounting a second sight to said firearm along said longitudinal axis of said firearm so that said second sight is pivotally spaced from said first sight.

12. The method of claim 11, wherein in step "d" said user pivots said firearm to utilize one of said first or second sights to aim said firearm at said first target.

13. The method of claim 12, wherein in step "d" there is provided the further step:

d1. pivoting the firearm from one of said first or second sights to the other sight to aim said firearm at a second target.

14. The method of claim 13, wherein said second sight is mounted at a forty-five-degree angle relative to said first sight.

15. The method of claim 13, wherein said second sight is mounted at a ninety-degree angle relative to said first sight.

* * * * *